US007150357B2

(12) United States Patent
Rodopoulos et al.

(10) Patent No.: US 7,150,357 B2
(45) Date of Patent: Dec. 19, 2006

(54) SELECTIVE RECOVERY OF MINERALS BY FLOTATION

(75) Inventors: Theo Rodopoulos, Blackburn South (AU); Ewen J Silvester, Brighton North (AU)

(73) Assignee: Commonwealth Scientific and Industrial Research Organisation (AU)

( * ) Notice: Subject to any disclaimer, the term of this patent is extended or adjusted under 35 U.S.C. 154(b) by 13 days.

(21) Appl. No.: 10/477,532

(22) PCT Filed: May 13, 2002

(86) PCT No.: PCT/AU02/00587

§ 371 (c)(1),
(2), (4) Date: Apr. 30, 2004

(87) PCT Pub. No.: WO02/092234

PCT Pub. Date: Nov. 21, 2002

(65) Prior Publication Data

US 2004/0200760 A1 Oct. 14, 2004

(30) Foreign Application Priority Data

May 14, 2001 (AU) ..... PR 5002

(51) Int. Cl.
*B03D 1/012* (2006.01)
*B03D 1/02* (2006.01)
*B03D 1/06* (2006.01)

(52) U.S. Cl. ..... 209/166

(58) Field of Classification Search ..... 209/166; 252/61

See application file for complete search history.

(56) References Cited

U.S. PATENT DOCUMENTS 3,425,550 A * 2/1969 Baarson et al. ..... 209/166
3,425,551 A * 2/1969 Baarson et al. ..... 209/166
4,159,943 A 7/1979 Petrovich
4,172,029 A 10/1979 Hefner, Jr.

(Continued)

FOREIGN PATENT DOCUMENTS

AU 4979872 * 6/1974

(Continued)

OTHER PUBLICATIONS

Derwent Abstract Accession No. 97-224558/20 Class E14, J01, M25, RU 2067030 C1 (As Sibe Chem Metal Processes Inst.), Sep. 27, 1996.

(Continued)

*Primary Examiner*—Thomas M. Lithgow
(74) *Attorney, Agent, or Firm*—Pillsbury Winthrop Shaw Pittman LLP

(57) ABSTRACT

A method of recovering a target mineral from an ore containing the target mineral and an iron sulphide mineral comprising the steps of: a) grinding the ore to liberate target mineral from the iron sulphide mineral; b) forming a pulp of said ore; c) selecting a collector having the structure as follows: X—R—Y where R is a branched or straight chain hydrophobic hydrocarbon or polyether chain, and X and Y represent metal coordinating functional groups, d) add the collector to the pulp at a concentration at which the target mineral is able to be floated in preference to the iron sulphide mineral; and e) subjecting the pulp to froth flotation. The metal coordinating sulphur based functional groups may be identical or different.

11 Claims, 6 Drawing Sheets

U.S. PATENT DOCUMENTS

| | | | |
|---|---|---|---|
| 4,308,133 | A | 12/1981 | Meyer |
| 4,394,389 | A | 7/1983 | van't Riet et al. |
| 4,587,013 | A | 5/1986 | Nagaraj et al. |
| 5,015,367 | A | 5/1991 | Klimpel et al. |
| 5,173,176 | A | 12/1992 | Klimpel et al. |
| 6,211,164 | B1 | 4/2001 | Luo et al. |

FOREIGN PATENT DOCUMENTS

| | | | |
|---|---|---|---|
| CA | 771181 | * | 11/1967 |
| CA | 771182 | * | 11/1967 |
| DE | 2049865 | | 4/1972 |
| EP | 0 409 728 | A2 | 1/1991 |
| WO | 99/15157 | | 4/1990 |
| WO | 97/46228 | | 12/1997 |
| WO | 98/13142 | | 4/1998 |
| WO | 99/47522 | | 9/1999 |
| WO | 99/48495 | | 9/1999 |

OTHER PUBLICATIONS

Derwent Abstract Accession No. 88-290791/41 Class P41, SU 1382494 A (Leningrad Plekhanov Mine), Mar. 23, 1988.

Derwent Abstract Accession No. 96-257875/26 Class A97, J01, M25 (A 26), RU 2046671 C1 (Kirbitova N V), Oct. 27, 1995.

Derwent Abstract Accession No. 95-342876/44 Class E19, J01, M25, RU 2031732 C1 (As Sibe Irkut Organic Chem), Mar. 27, 1995.

Derwent Abstract Accession No. 86-237603/36 Class P41, SU 1207498 A (Mineral Resources (Auor=)), Jan. 30, 1986.

Chemical Abstracts, col. 58, No. 6, Mar. 18, 1963, Columbus, Ohio, US; abstract No. 5563c, K.C. Joshi et al: "Synthesis of fluorebenzoates as possible pesticides." p. 5563; column 1; XP002266801 abstract.

Chemical Abstracts, vol. 58, No. 4, Feb. 18, 1963, Columbus, Ohio, US; abstract No. 3341g, S.D. Jolad et al.: "Substituted benzophenones." p. 3341; column 1; XP002266802 abstract.

Database Crossfire Beilstein 'Online! Beilstein Institut Zur Foederung Der Chemischen Wissenschaften, Frankfurt AM Main, DE; Database-Accession No. 2274611 (BRN), XP002266804.

Database Crossfire Beilstein 'Online! Beilstein Institut Zur Foederung Der Chemischen Wissenschaften, Frankfurt AM Main, DE; Database-Accession No. 2583565 (BRN), XP002266805.

Database Crossfire Beilstein 'Online! Beilstein Institut Zur Foederung Der Chemischen Wissenschaften, Frankfurt AM Main, DE; Database-Accession No. 6608813 (BRN), XP002266806.

Database Crossfire Beilstein 'Online! Beilstein Institut Zur Foederung Der Chemischen Wissenschaften, Frankfurt AM Main, DE; Database-Accession No. 2649250, 2585603 (BRN), XP002266807.

Database Crossfire Beilstein 'Online! Beilstein Institut Zur Foederung Der Chemischen Wissenschaften, Frankfurt AM Main, DE; Database -Accession No. 2120541 (BRN), XP002266808.

Database Crossfire Beilstein 'Online! Beilstein Institut Zur Foederung Der Chemischen Wissenschaften, Frankfurt AM Main, DE; Database-Accession No. 3295520 (BRN), XP002266809.

Database Crossfire Beilstein 'Online! Beilstein Institut Zur Foederung Der Chemischen Wissenschaften, Frankfurt AM Main, DE; Database-Accession No. 2121991 (BRN), XP002266810.

Chemical Abstracts, vol. 92, No. 22, Jun. 2, 1980, Columbus, Ohio, US; abstract No. 189424e, Deutscher H.J. et al; "Liquid-crystalline hidroquinone bis(trans-4-n-alkylcyclohexanecarboxylates).", p. 559; column 2; XP002266803 abstract.

* cited by examiner

SELECTIVE RECOVERY OF MINERALS BY FLOTATION

This application is the National Phase of International Application PCT/AU02/00587 filed 13 May 2002 which designated the U.S. and that International Application

BACKGROUND OF THE INVENTION

This invention relates to a method for the beneficiation of ores by a froth flotation process and in particular using a collector having two hydrophilic polar head groups.

DESCRIPTION OF THE PRIOR ART

Froth flotation is one of the most widely used separation processes for the upgrading of ores. With the steady depletion of high grade, easy-to-process ores the exploitation of low grade, more complex and disseminated ore reserves has become necessary. This has forced the mineral processing industry to adopt more sophisticated and innovative separation technologies for concentrating valuable minerals. In terms of flotation, the development of more selective collectors is critical to its success in treating these low grade, difficult-to-process ores.

Most, if not all, collectors employed in the selective separation of minerals by froth flotation are monochelating ligands. A large proportion of these are monopolar. They are comprised of a single hydrophilic polar head group and a hydrophobic chain. One class of collectors, known as the thio compounds, coordinate metal ions through their sulphur atoms. Two examples of this class are the dithiocarbonates, otherwise known as xanthates, and dithiocarbamates. These are derived from alcohols and amines, respectively.

Xanthates, specifically, have been known for almost two centuries. Since 1925, when they were first introduced as sulphide mineral collectors, they have virtually been the collector of choice due to their performance, low production cost and straightforward synthesis. However, there has been a market shift towards alternate novel collectors such as dithiophosphates, dithiophosphinates, xanthogen formates, mercaptobenzothiazoles and thionocarbamates. The need for more selective collectors, which can recover all particles in the comminuted ore and operate over a wider range of conditions, has been the catalyst for this market shift. Also, the depletion of high grade, easy-to-process ores has forced the mineral processing industry to adopt more sophisticated separation technologies and more selective and efficient collectors.

Selectivity in froth flotation is controlled by the selective adsorption of reagents on minerals at the mineral/water interface. Reagents that impart sufficient hydrophobic character to minerals on adsorption, such that they are rendered floatable, are referred to as collectors. In general, the commercial collectors currently used were discovered through trial and error or educated guesswork based on their metal ion coordination properties. Extensive research and development efforts in the area of flotation collectors have not resulted in a process which can assist metallurgists and engineers in selecting collectors for given mineral separation problems. Collectors are usually chosen on the basis of past personal experiences, experiences of others, recommendations from reagent manufacturers, and reagent cost.

It was envisaged that collector molecules possessing two functional head groups separated by a hydrophobic molecular chain would display a greater mineral selectivity than the monofunctional collector molecules currently adopted by the mineral processing industry. The applicants have found that the choice of functional group as well as the length of the molecule governs the ultimate mineral selectivity displayed by the bifunctional molecule. In a particular mineral system variation of the distance between the two functional groups alters the selectivity for the target mineral over the gangue mineral/s.

SUMMARY OF THE INVENTION

According to one aspect of the invention it provides a method of selectively recovering a target sulphide mineral from an ore containing the target sulphide mineral and an iron sulphide gangue mineral comprising the steps of:

a) grinding the ore to liberate target sulphide mineral from the iron sulphide gangue mineral;

b) forming a pulp of said ore;

c) selecting a collector having two hydrophilic functional head groups and a hydrophobic molecular chain between the head groups;

d) adding the collector at a concentration at which the target mineral can be floated in preference to the iron sulphide gangue mineral; and e) subjecting the pulp to froth flotation.

In a preferred embodiment of the invention, the bifunctional head groups are sulphur based.

In accordance with another aspect of the invention, there is provided a method of recovering a target mineral from an ore containing the target mineral and an iron sulphide gangue mineral comprising the steps of:

a) grinding the ore to liberate target mineral from the iron sulphide mineral;

b) forming a pulp of said ore;

c) selecting a collector having the structure as follows:

X—R—Y where R is a branched or straight chain hydrophilic hydrocarbon or polyether chain, and X and Y represent metal coordinating functional groups, d) add the collector to the pulp at a concentration at which the target mineral is able to be floated in preference to the iron sulphide gangue mineral; and e) subjecting the pulp to froth flotation.

The metal coordinating sulphur based functional groups may be identical or different.

The applicants have found that molecules with two hydrophilic metal-coordinating moieties could distinguish between different minerals and bring about different flotation responses depending on the molecular distance between the two metal-coordinating moieties. In a preferred form of the invention the hydrophilic functional head groups at each end of the hydrophobic chain are substantially identical. In the context of the present invention, the sulphur based hydrophilic head groups are selected from the group consisting of xanthates (dithiocarbonates) and dithiocarbamates. While these hydrophilic head groups are specifically discussed, the use of other hydrophilic head groups is within the scope of the invention.

Once the appropriate polar head groups are selected, trials may be conducted to determine the optimum molecular chain length between the functional head groups. The applicants consider that the preferred chain length contains 2–6 carbon atoms with a chain length of 2–4 carbon atoms may be desirable in some cases, however the invention is not restricted to this chain length nor straight chain molecules. The length of the bridging molecular chain is dependent on the minerals being separated. It is desirable to select the chain length that gives the desired mineral selectivity of the target mineral over the gangue mineral.

Prior to mineral recovery, it is preferable that the pH is adjusted to a predetermined value where flotation selectivity of said target mineral is at a maximum, followed by pulp aeration to raise the pulp potential. The selected collector is then added and the pulp may be conditioned. After the conditioning time has elapsed recovery of the said mineral by flotation begins with air.

A series of bifunctional ligands based on xanthates and dithiocarbamates were synthesised and characterised in order to test and demonstrate the invention. The structure of the bifunctional, dipolar ligands investigated are shown in FIG. 1 along with the simpler, commercially available, monochelating, monopolar potassium ethyl xanthate (KeX) and potassium n-propyl xanthate (KnPrX) collectors. The bifunctional ligands possess two polar head groups linked by relatively short hydrocarbon or polyether chains. In order for these bifunctional ligands to behave as collectors they should not be polymeric like cellulose xanthate.

DESCRIPTION OF THE PREFERRED EMBODIMENT

The invention will now be further described with reference to the following preferred embodiment and accompanying drawings in which:

FIG. 1(*a*) to (*h*) is schematic view of the structure of bifunctional, dipolar and monofunctional, monopolar thio ligand structures; and FIG. 2(*a*) to (*b*) is a schematic view illustrating the possible modes of adsorption of bifunctional, dipolar ligands.

Figure 1:
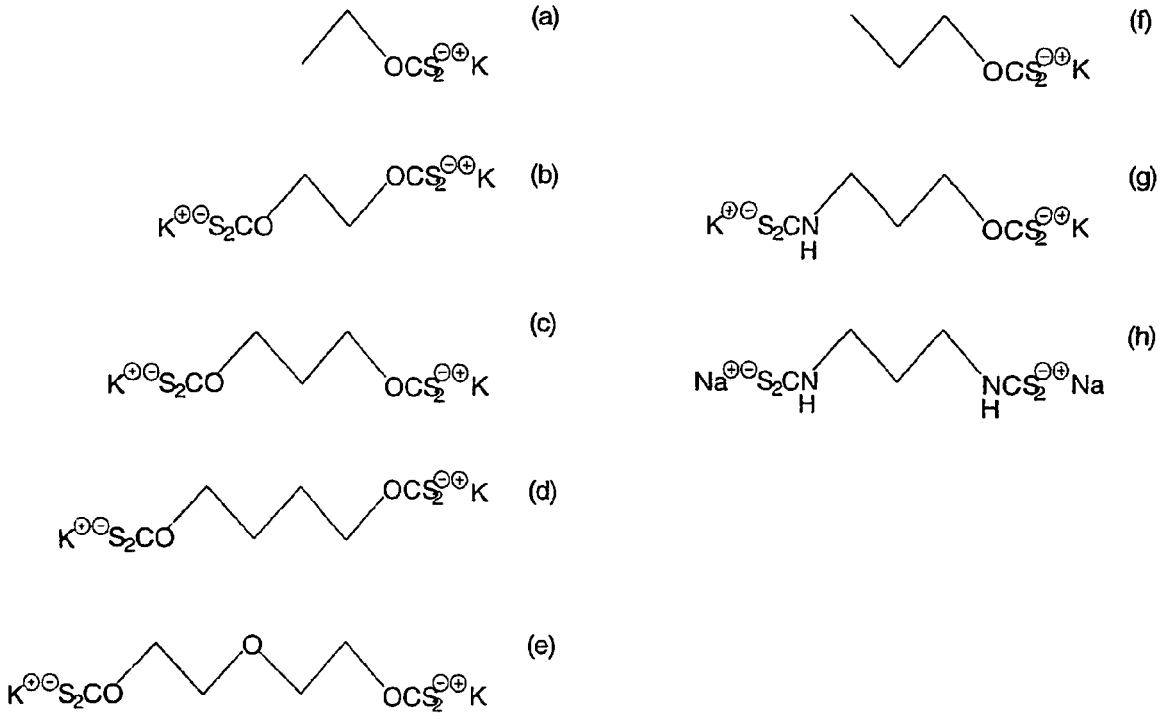
Figure 2:
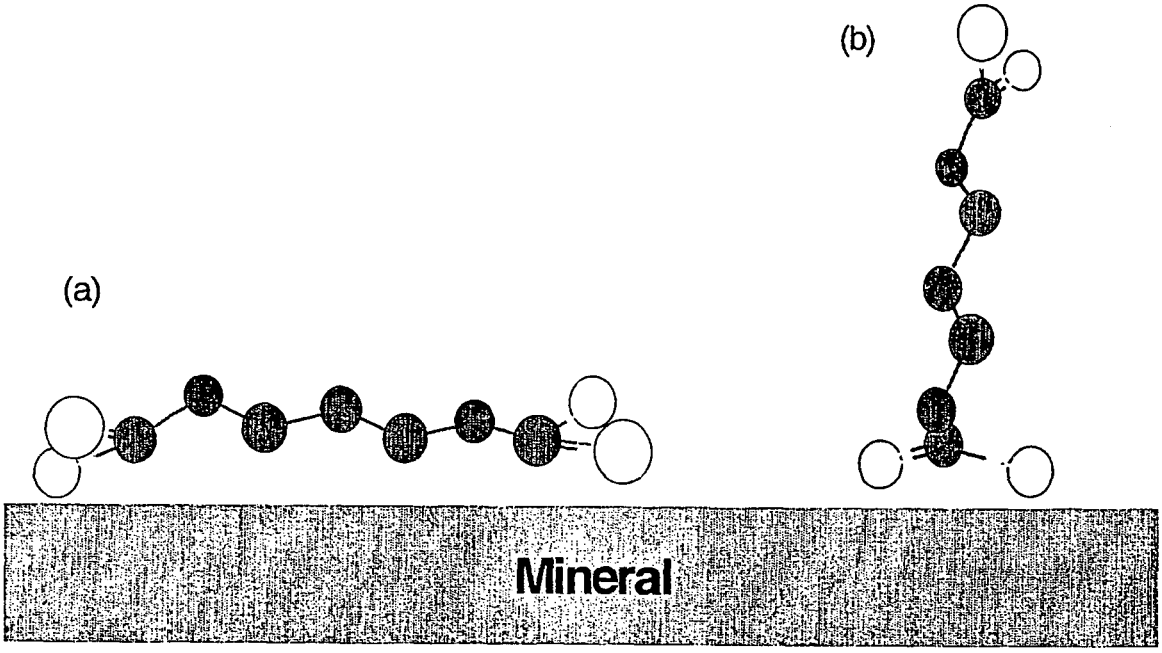

While aromatic and branched carbon structures may also be used, from the structure of the bifunctional, dipolar ligands shown in FIG. 1, it was envisaged that they could adsorb to a mineral surface in two ways which could lead to two very different flotation responses. The two modes of adsorption of a propylene bridged dipolar ligand ($PrDX^{2-}$) on a mineral surface are illustrated in FIG. 2. Adsorption through both of the polar head groups, as depicted in FIG. 2(*a*), would render the mineral hydrophobic and enable the mineral to be floated. However, if adsorption occurs through only one of the polar head groups, as depicted in FIG. 2(*b*), the mineral would be rendered hydrophilic and result in its depression. The depictions in FIG. 2 are merely schematics, should be treated as simplifications of the actual collector adsorption process and so are not intended to be limiting or binding on the scope of the invention.

The applicants have found that by using collectors with two polar heads, greater selectivity for the target mineral over iron sulphide gangue minerals can be obtained under certain experimental conditions.

In order to recover a mineral from an ore by flotation in accordance with the invention, prior to carrying out the flotation, it is first necessary to determine the molecular nature of the bifunctional, dipolar, nonpolymeric collector most suited to the target mineral. This includes the nature of the functional groups and the length of the molecular chain between the two functional groups which will provide maximum recovery and selectivity. It is then necessary to determine the optimal concentration of collector which will maximise recovery and selectivity.

The invention will now be further illustrated by reference to the following examples. While the invention will be illustrated by reference to the recovery of specific target sulphidic minerals, it will be understood that the invention is applicable to the recovery of other types of sulphidic minerals mixed with iron sulphide minerals. Single mineral flotation tests using bifunctional collectors were conducted to demonstrate the parameters affecting the recovery of the target minerals whereas the flotation tests using ores were conducted to demonstrate their effect on mineral selectivity.

Galena/Quartz Flotation Tests

The galena used in the single mineral flotation tests was selected from high grade ore from Broken Hill, New South Wales and assayed 83.7% Pb, 1.0% Zn, 0.8% Fe and 14.0% S. Quartz was a high quality Australian product.

The following general preparation and flotation procedure for the galena/quartz mixture was used:

The galena was prepared for flotation by crushing to pass 1.65 mm and rejecting the minus 0.208 mm material. It was then divided into 50 g lots by standard means. For each flotation test galena (50 g), quartz (450 g) and Melbourne tap water (0.25 L) were ground together in a laboratory stainless steel mill using stainless steel balls for 20 minutes at 67 wt % solids to give a $P_{80}$ (80% passing size) by weight and lead of 115 μm and 36 μm, respectively. The pH of the ground galena/quartz mixture was about 6.

The ground pulp was transferred from the grinding rill to a modified 3 L Denver stainless steel flotation cell. The water level was raised to 2.8 L by adding Melbourne tap water, the pH adjusted to 8.5 with NaOH and the pulp aerated using 8 L $min^{-1}$ of synthetic air for 5 minutes. The pulp was agitated at 1200 r.p.m. Collector (0.125 mol/t) was then added and the pulp conditioned for 5 minutes in the absence of aeration. Frother (5 mg/min, total of 45 g/t)) was added continuously during the flotation test 4 minutes into conditioning and 1 minute before turning the air on and commencing flotation. The frother was commercially available Cytec Aerofroth 65 containing polypropylene glycol. Concentrates were collected for 8 minutes.

The pulp level was maintained throughout the float by continual automatic additions of fresh Melbourne tap water. Products (concentrates and tailings) were weighed wet and dry and a representative sample of each was pulverised and assayed for Pb and S by inductively coupled plasma-atomic emission spectrometry (ICP-AES).

Variations to the collector dose and the collector conditioning time were made at the appropriate stage of the flotation procedure.

Further details of the flotation procedure need not be described here, as they are well known to those skilled in the art.

In order to make the comparison of collector performance for the various collectors tested more meaningful, the collectors were initially compared on an equimolar basis (i.e. moles/t of ore, rather than g/t or lb/t of ore). The collectors were tested in accordance with the flotation procedure detailed above, and the results are presented in Table 1 and 2.

TABLE 1

Effect of chain length
Galena/Quartz mixture:
pH 8.5, 45 g/t A65, 0.125 mol/t collector

| Example | Collector | Dose (mol/t) | Galena Recovery (%) |
|---|---|---|---|
| A | — | 0 | 65.0 |
| B | KeX | 0.125 | 92.8 |
| C | $K_2$EtDX | 0.125 | 81.9 |
| D | $K_2$PrDX | 0.125 | 79.7 |
| E | $K_2$BuDX | 0.125 | 87.7 |

TABLE 2

Effect of dose
Galena/Quartz mixture:
pH 8.5, 45 g/t A65, 0.125 mol/t collector

| Example | Collector | Dose (mol/t) | Galena Recovery (%) |
|---|---|---|---|
| A | — | 0 | 65.0 |
| B | KeX | 0.125 | 92.8 |
| F | $K_2$EtDX | 0.034 | 78.6 |
| G | $K_2$EtDX | 0.069 | 85.7 |
| C | $K_2$EtDX | 0.125 | 81.9 |
| H | $K_2$PrDX | 0.066 | 95.4 |
| D | $K_2$PrDX | 0.125 | 79.7 |
| I | $K_2$PrDX | 0.374 | 62.4 |

Figure 3:
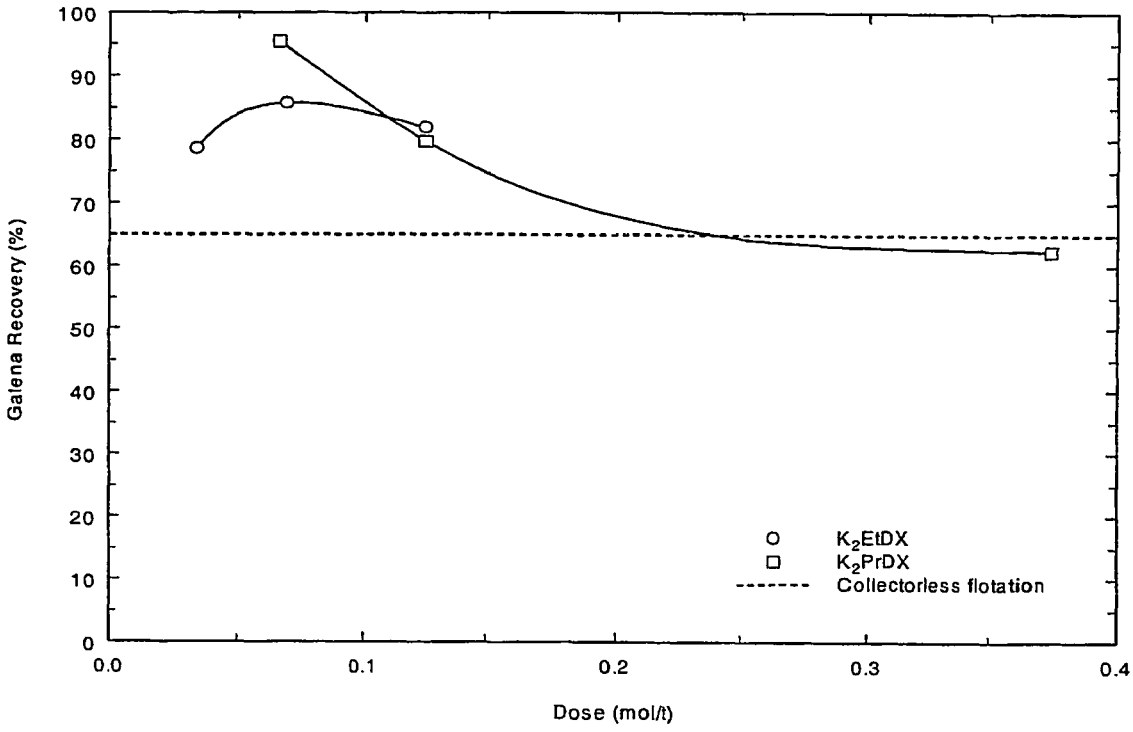
FIG. 3 is a graph of the effect of dixanthate collector dose on galena recovery.

The results in Table 1 demonstrate the variability in galena recovery upon altering the bifunctional collector chain length. The data in Table 2 shows that the galena recovery can vary significantly upon varying the bifunctional collector dose. FIG. 3 graphically shows the effect of bifunctional collector dose on galena recovery. Clearly a higher bifunctional collector dose is not necessarily better for a higher galena recovery.

Galena recovery in Example I in Table 2, where an excessive dose of $K_2$PrDX was employed, was lower than that achieved in Example A, where collectorless flotation of galena was conducted. This suggests that excessive bifunctional collector doses may depress the target mineral.

Results in Table 1 and 2 therefore demonstrate that a link exists between the bifunctional collector chain length, bifunctional collector dose and target mineral recovery.

Galena/Pyrite/Quartz Flotation Tests

Galena and pyrite single mineral recovery data using $K_2$BuDX (0.125 mol/t) over the pH range 5–12 is shown in Table 3. The general preparation and flotation procedure for the pyrite/quartz flotation tests was the same as that described for the galena/quartz flotation tests earlier. The pyrite single mineral flotation tests were conducted using 50 g pyrite/450 g quartz mixtures. The high grade specimen of pyrite (Peru) was purchased from Ward's Natural Science Establishment. The pyrite assayed 42.2% Fe, 49.6% S, 0.28% Cu. 0.20% Pb, 0.28% Zn and 1.11% Si. Quartz was a high quality Australian product.

TABLE 3

| Example | pH | Galena Recovery (%) | Pyrite Recovery (%) |
|---|---|---|---|
| A | 5 | 79.0 | 77.7 |
| B | 7 | 88.2 | 86.9 |
| C | 8.5 | 87.7 | 89.1 |
| D | 10 | 88.8 | 88.2 |
| E | 12 | 94.2 | 57.2 |

Figure 4:
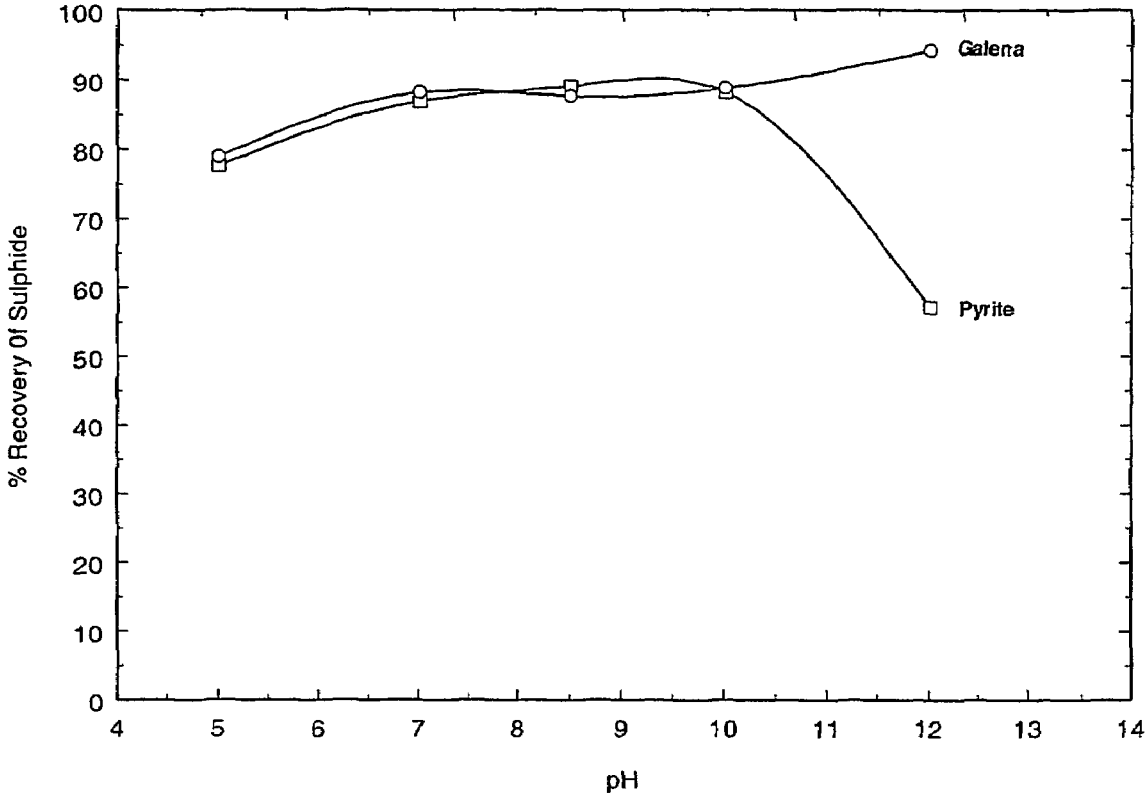
FIG. 4 is a graph of a comparison of the pH dependencies of pyrite and galena recovery using $K_2$BuDX.

The results in this table are shown in FIG. 4. It was noted that there was a distinct difference in the recovery of galena and pyrite using $K_2$BuDX at high pH (12). Galena recovery remains high at pH 12 whilst pyrite recovery is significantly reduced. Hence, the selectivity for galena over pyrite was investigated using $K_2$BuDX from a galena/pyrite/quartz mixture.

The galena/pyrite/quartz mixture comprised 50 g galena, 150 g pyrite and 300 g quartz. Once again, the general preparation and flotation procedure for the galena/pyrite/quartz flotation tests was the same as that described for the galena/quartz flotation tests earlier. The galena and pyrite recoveries from the galena/pyrite/quartz mixtures using $K_2$BuDX (0.125 mol/t) at pH 12 are presented in Table 4.

Included in Table 4 are the Galena/Pyrite selectivity indexes for the collector in each test. The Gn/Py selectivity index was defined and calculated in accordance with the equation:

$$\text{Gn/Py Selectivity Index} = \frac{\ln(\text{Fraction remaining Galena})}{\ln(\text{Fraction remaining Pyrite})}$$

The selectivity index is a convenient method for indicating the relative recovery and relative rejection of two minerals, in this instance, galena and pyrite. A selectivity index value <1.0 indicates that the collector is more selective for pyrite. If it is equal to 1.0 it means that the collector does not display any selectivity for one mineral over the other. Whereas, if it is >1.0 it means that the collector is more selective for galena. Increasing selectivity index indicates improving selectivity for galena over pyrite.

TABLE 4

| Example | Collector | Dose (mol/t) | Galena Recovery (%) | Pyrite Recovery (%) | Gn/Py Selectivity Index |
|---|---|---|---|---|---|
| F | KeX | 0.125 | 27.6 | 4.5 | 7.01 |
| G | $K_2$BuDX | 0.125 | 66.2 | 12.1 | 8.41 |

According to the calculated Gn/Py selectivity indexes $K_2$BuDX displayed a greater selectivity for galena over pyrite than the commercial collector KeX. Recovery of galena was lower than that achieved in the galena/quartz test (galena recovery result in Example E in Table 3) due to the presence of pyrite and the fact that the bifunctional collector dose was not adjusted to account for the greater sulphide mineral content.

Pentlandite/Quartz and Chalcopyrite/Quartz Flotation Tests

Pentlandite/quartz and chalcopyrite/quartz flotation tests were also conducted to evaluate the effect of the bifunctional collectors on pentlandite and chalcopyrite recovery.

The pentlandite sample was concentrated from a high grade nickel sulphide ore obtained from Kambalda, Western Australia. It assayed 29.2% Ni, 31.9% Fe, 34.6% S, 0.64% Cu. 0.13% As, 0.51% Co, 0.04% Pb, 0.01% Zn and 0.20% MgO. Quartz was a high quality Australian product.

The general preparation and flotation procedure for the pentlandite/quartz mixtures was the same as that described for the galena/quartz mixtures earlier. The pentlandite/quartz tests were however conducted at pH 9.0 with a collector dose of 0.749 mol/t. The results of the pentlandite/quartz flotation tests using the commercial collector KeX, and the bifunctional collectors $K_2$EtDX, $K_2$PrDX and $K_2$BuDX as well as no collector (ie. collectorless flotation) are shown in Table 5.

TABLE 5

Pentlandite/Quartz mixture: pH 9.0, 45 g/t A65, 0.749 mol/t collector

| Example | Collector | Dose (mol/t) | Pentlandite Recovery (%) |
|---|---|---|---|
| A | — | 0 | 54.4 |
| B | KeX | 0.749 | 96.4 |
| C | $K_2$EtDX | 0.749 | 96.5 |
| D | $K_2$PrDX | 0.749 | 93.9 |
| E | $K_2$BuDX | 0.749 | 92.2 |

The chalcopyrite sample used in the chalcopyrite/quartz mixtures was selected from a high grade ore from Mt Lyell, Tasmania. It assayed 34.1% Cu, 30.7% Fe, 34.1% S, 0.004% Pb and 0.08% Zn. Quartz was a high quality Australian product.

Once again the general preparation and flotation procedure for the chalcopyrite/quartz mixtures was essentially the same as that described for the galena/quartz mixtures earlier. The chalcopyrite/quartz mixtures were however ground in a laboratory steel mill using steel balls for 15 minutes. Also, the flotation tests were conducted at pH 10.5 with a collector dose of 0.250 mol/t. The results of the chalcopyrite/quartz flotation tests using the commercial collector KeX, and the bifunctional collectors $K_2$EtDX, $K_2$PrDX and $K_2$BuDX as well as no collector (ie. collectorless flotation) are shown in Table 6.

TABLE 6

Chalcopyrite/Quartz mixture pH 10.5, 45 g/t A65, 0.250 mol/t collector

| Example | Collector | Dose (mol/t) | Chalcopyrite Recovery (%) |
|---|---|---|---|
| A | — | 0 | 46.3 |
| B | KeX | 0.250 | 78.0 |
| C | $K_2$EtDX | 0.250 | 62.4 |
| D | $K_2$PrDX | 0.250 | 63.3 |
| E | $K_2$BuDX | 0.250 | 75.8 |

The galena, pentlandite and chalcopyrite single mineral flotation test results shown in Tables 1, 5 and 6, respectively, demonstrate that the different chain length dixanthates gave different flotation responses for the different minerals. At the equimolar doses examined, $K_2$EtDX was the better performing dixanthate for pentlandite whereas $K_2$BuDX was the better performing dixanthate for galena and chalcopyrite. In comparison to the commercial collector KeX (at an equimolar dose), the dixanthates do not necessarily give higher recoveries than KeX. Hence, the applicants do not contend that the dixanthates are stronger collectors than standard commercial monoxanthates.

In order to demonstrate the selection of an appropriate bifunctional collector for the recovery of a target sulphidic mineral from an ore comprising the target sulphidic mineral and tile iron sulphide gangue, the following examples are provided.

EXAMPLE 1

Ore A

The head assay of this Australian nickel sulphide ore is 3.89% Ni, 16.85% Fe, 10.42% S, 0.29% Cu, and 8.66% MgO. Nickel was predominantly present as pentlandite ($(Ni,Fe)_9S_8$), the copper was present as chalcopyrite ($CuFeS_2$) and the principle sulphide gangue comprised pyrrhotite ($Fe_{1-x}S$) and pyrite ($FeS_2$), predominantly pyrrhotite. Therefore, the ore contained 5.70% iron sulphides (IS).

The following general preparation and flotation procedure for Ore A was used:

Ore A was crushed to pass 1.65 mm, blended and divided in 1000 g lots by standard means. The nickel ore charge (1000 g) was mixed with Melbourne tap water (0.5 L) and lime (0.5 g) and ground in a laboratory mild steel rod mill containing mild steel rods for 30 minutes at 67 wt % solids to give a $P_{80}$ (80% passing size) by weight of 74 μm. At this size the nickel was expected to be well liberated. Sufficient lime was added to the grinding mill to give a pulp pH of approximately 9 when the ground pulp was placed in the flotation cell.

The ground pulp sample was transferred from the grinding mill to a modified 3 L Denver stainless steel cell. The volume of the pulp was raised to 2.8 L by adding Melbourne tap water, the pH adjusted to 9.0 by adding dilute NaOH, and the pulp aerated using 8 L $min^{-1}$ of synthetic air for 5 minutes. The pulp was agitated at 1200 r.p.m.

After aeration, collector (0.468 mol/t) was added to the pulp and the pulp conditioned for 5 minutes. Frother (5 mg/min, total of 135 g/t)) was added continuously during the roughing flotation test from 3 minutes into the conditioning stage. The frother was commercially available Cytec Aerofroth 65 containing polypropylene glycol. Guar gum (150 g/t) was added 4 minutes into the conditioning stage and 1 minute before the commencement of flotation. Aeration of the pulp was resumed and rougher concentrates collected for 27 minutes. During the float a further two additions of collector (0.312 mol/t and 0.156 mol/t) were made after 3 and 17 minutes. For both of these additions, the pulp was conditioned for 1 minute with the air off before flotation was recommenced.

For some of the tests cleaning was performed on the combined rougher concentrates. The concentrates from the rougher stage of the float were combined, decanted and repulped in a 1 L cell using the decanted filtered liquor from the rougher concentrates. Collector (0.150 mol/t) was added to the pulp and the pulp conditioned for 5 minutes without aeration. No frother was added during cleaning and the aeration rate reduced to 6 L $min^{-1}$. Aeration of the pulp was resumed 15 seconds before the start of flotation and cleaner concentrates were collected for 10 minutes.

The pulp level was maintained throughout the float by continual automatic additions of fresh Melbourne tap water. Products (concentrates and tailings) were weighed wet and dry and a representative sample of each was pulverised and assayed for Ni, Fe, S, Mg and Cu by inductively coupled plasma-atomic emission spectrometry (ICP-AES).

Further details of the flotation procedure need not be described here, as they are well known to those skilled in the art.

In order to make the comparison of collector performance for the various collectors tested more meaningful, the collectors were compared on an equimolar basis (ie. moles/t of ore, rather than g/t or lb/t of ore). However, the doses have also been expressed in g/t in Table 7 to provide an indication of the weights involved. The collectors were tested in accordance with the flotation procedure detailed above, and the results are presented in Table 7 below.

Included in Table 7 are the Ni/IS (iron sulphide) selectivity indexes for the collector in each test. The Ni/IS selectivity index was defined and calculated in accordance with the equation:

$$\text{Ni/IS Selectivity Index} = \frac{\ln(\text{Fraction remaining Ni})}{\ln(\text{Fraction remaining IS})}$$

TABLE 7

Ore A:
pH 9.0, 500 g/t lime, 135 g/t A65, 0.468–1.086 mol/t collector

| Example | Collector | Dose (mol/t) | Dose (g/t) | Ni Recovery (%) | Ni Grade (%) | IS[a] Recovery (%) | Ni/IS Selectivity Index |
|---|---|---|---|---|---|---|---|
| Rougher | | | | | | | |
| A | KeX | 0.936 | 150 | 93.0 | 7.07 | 64.7 | 2.55 |
| B | $K_2$EtDX | 0.936 | 272 | 94.4 | 8.02 | 61.6 | 3.01 |
| B' | $K_2$EtDX | 0.468 | 136 | 91.5 | 8.40 | 52.1 | 3.34 |
| C | $K_2$PrDX | 0.936 | 285 | 95.7 | 7.99 | 75.6 | 2.23 |
| D | $K_2$BuDX | 0.936 | 298 | 96.2 | 7.87 | 76.5 | 2.25 |
| Rougher-Cleaner | | | | | | | |
| E | KeX | 1.086 | 174 | 86.4 | 9.41 | 55.2 | 2.48 |
| F | $K_2$EtDX | 0.537 | 156 | 86.2 | 10.52 | 45.3 | 3.28 |

[a]IS = Iron sulphide sulphur.

As shown by the data of Table 7, the dixanthate collectors used in accordance with the invention shown in Examples B–D gave a better metallurgical performance in terms of Ni recovery as compared to the conventional collector of Example A at an equimolar dose. The dixanthate in Example B also recovered less iron sulphides than the conventional collector in Example A. As a result this dixanthate displayed an improved Ni selectivity over the iron sulphides and an improved Ni grade in comparison to the conventional collector in Example A.

Although the dixanthates in Examples C and D yielded a higher Ni recovery than the conventional collector in Example A they also recovered a greater proportion of the iron sulphides. These Examples illustrate that if an inappropriate chain length dixanthate is chosen then optimum selectivity of the valuable mineral over the iron sulphides will not be achieved.

In Example E 0.936 mol/t KeX was used in the rougher stage and 0.150 mol/t in the cleaning stage. It was noted that an equimolar dose of the $K_2$EtDX dixanthate in the rougher stage was excessive and that a similar Ni recovery could be achieved with half the molar dose (see Example B'). Hence, in Example F 0.468 mol/t $K_2$EtDX was used in the rougher stage and 0.069 mol/t $K_2$EtDX in the cleaning stage. Comparing Examples E and F it can be seen that $K_2$EtDX recovered 10% less of the iron sulphides than KeX whilst achieving a similar Ni recovery. This lead to an improved Ni/IS selectivity index and a 1.1% improvement in the Ni grade after one stage of cleaning. The results of Examples E and F demonstrate the mineral selectivity superiority and the iron sulphide rejection capability of the dixanthate collectors of this invention. It is worth noting that the improved result in Example F in comparison to Example E was also achieved with a lower collector dose on a weight basis.

EXAMPLE 2

Ore B

The head assay of this Australian copper sulphide ore is 1.14% Cu, 25.48% Fe and 5.91% S. Chalcopyrite was the only copper mineral present and the iron sulphide gangue was present as pyrite. Therefore, the ore contained 4.75% pyrite.

The following general preparation and flotation procedure for Ore B was used:

Ore B was crushed to −2 mm, blended and divided in 1000 g lots by standard means. The copper ore charge (1000 g) was mixed with Melbourne tap water and ground in a laboratory mild steel ball mill containing mild steel balls for 30 minutes at 67 wt % solids to give a Pso (80% passing size) by weight of approximately 80 μm. The ground pulp sample was transferred to a modified 3 L Denver stainless steel cell and the volume of the pulp adjusted by adding Melbourne tap water to give a pulp density of about 26 wt % solids. The pulp was agitated at 1200 r.p.m.

The pH of the ground pulp in the cell was approximately 9.0. Lime (250 g/t) was added to the pulp to give a pH of 10.5 and the pulp aerated using 8 L $min^{-1}$ of synthetic air for 5 minutes. Aeration of the pulp was ceased and collector (0.024 mol/t) was added to the pulp and the pulp conditioned for 5 minutes. Frother (40 g/t total) was added continuously to the pulp from a motorised dispenser commencing 1 minute before flotation. The frother was commercially available Cytec Aerofroth 65 containing polypropylene glycol. Aeration was resumed and flotation products (i.e. concentrates) were collected for a predetermined time (11 minutes). During the float a further three additions of collector (0.007 mol/t each) were made after 3, 5 and 8 minutes. For each of these additions, the pulp was conditioned for 1 minute with the air off before flotation was recommenced. The pulp level was maintained throughout the float by continual automatic additions of fresh Melbourne tap water. Products (concentrates and tailings) were weighed wet and dry and a representative sample of each was pulverised and assayed for Cu, Fe and S by inductively coupled plasma-atomic emission spectrometry (ICP-AES).

Further details of the flotation procedure need not be described here, as they are well known to those skilled in the art.

In order to make the comparison of collector performance for the various collectors tested more meaningful, the collector doses are expressed in moles/t of ore, rather than g/t or lb/t of ore. The collectors were tested in accordance with the flotation procedure detailed above, and the results are presented in Table 8 below.

Included in Table 8 are the Cu/Pyrite selectivity indexes for the collector in each test. The Cu/Pyrite selectivity index was defined and calculated in accordance with the equation:

$$\text{Cu/Pyrite Selectivity Index} = \frac{\ln(\text{Fraction remaining Cu})}{\ln(\text{Fraction remaining Pyrite})}$$

Cu/Pyrite Selectivity Index ln(Fraction remaining Cu) ln(Fraction remaining Pyrite)

TABLE 8

Ore B:
pH 10.5, 250 g/t lime, 40 g/t A65, 0.045 mol/t collector

| Example | Collector | Dose (mol/t) | Cu Recovery (%) | Cu Grade (%) | Pyrite Recovery (%) | Cu/Py Selectivity Index |
|---|---|---|---|---|---|---|
| A | SiBX | 0.090 | 95.3 | 7.61 | 87.3 | 1.48 |
| B | $K_2$EtDX | 0.090 | 84.1 | 20.70 | 5.4 | 33.12 |
| C | SiBX | 0.045 | 93.9 | 10.56 | 51.4 | 3.88 |
| D | $K_2$EtDX | 0.045 | 82.8 | 23.52 | 2.5 | 69.53 |
| E | $K_2$PrDX | 0.045 | 81.3 | 16.90 | 18.4 | 8.25 |
| F | $K_2$BuDX | 0.045 | 87.1 | 20.17 | 11.9 | 16.16 |

As shown by the data of Table 8, the dixanthate collectors of this invention shown in Examples B and D–F gave a better metallurgical performance in terms of Cu selectivity over pyrite as compared to the conventional collector of Example A and C, respectively, at an equimolar dose. As a consequence of the improved Cu selectivity over pyrite the Cu grade of the concentrate for Examples B and D–F were significantly improved when compared to that of Examples A and C, respectively. These results clearly demonstrate the mineral selectivity superiority and the iron sulphide rejection capability of the dixanthate collectors of this invention.

Although the dixanthates display an improved Cu/Py selectivity their performance in terms of Cu recovery in comparison to that of SiBX is poorer. The lower Cu recoveries obtained from this ore using the dixanthates is related to their iron sulphide (pyrite in this case) rejection capabilities. Copper that is completely locked within pyrite particles or composite pyrite/Cu particles will be rejected by the dixanthates leading to lower overall Cu recoveries.

Figure 5:
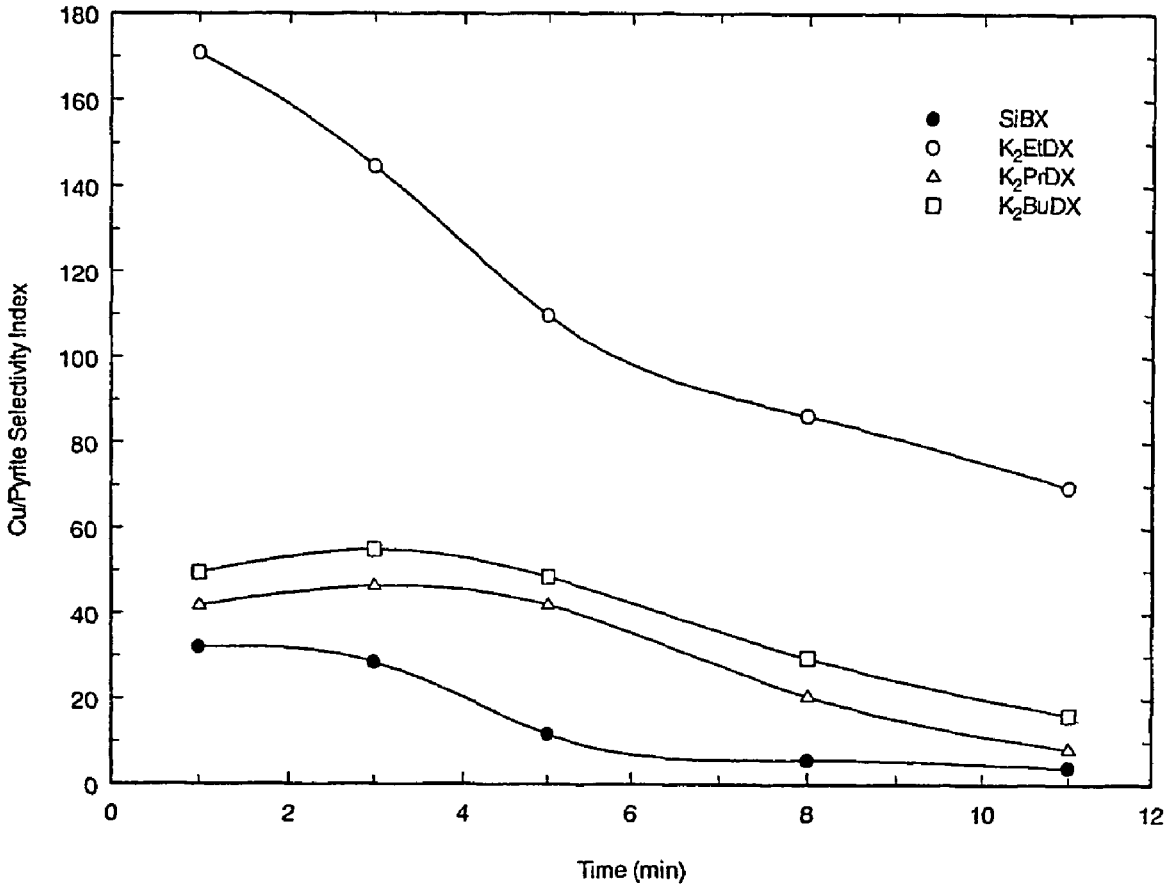
FIG. 5 is a graph of a comparison of the Cu/Pyrite selectivity index throughout Cu ore floats using 0.045 mol/t sodium iso-butyl xanthate (SiBX), $K_2$EtDX, $K_2$PrDX and $K_2$BuDX.

FIG. 5 shows that the dixanthate collectors displayed a better Cu/Pyrite selectivity than the commercial collector SiBX throughout the entire float.

Figure 6:
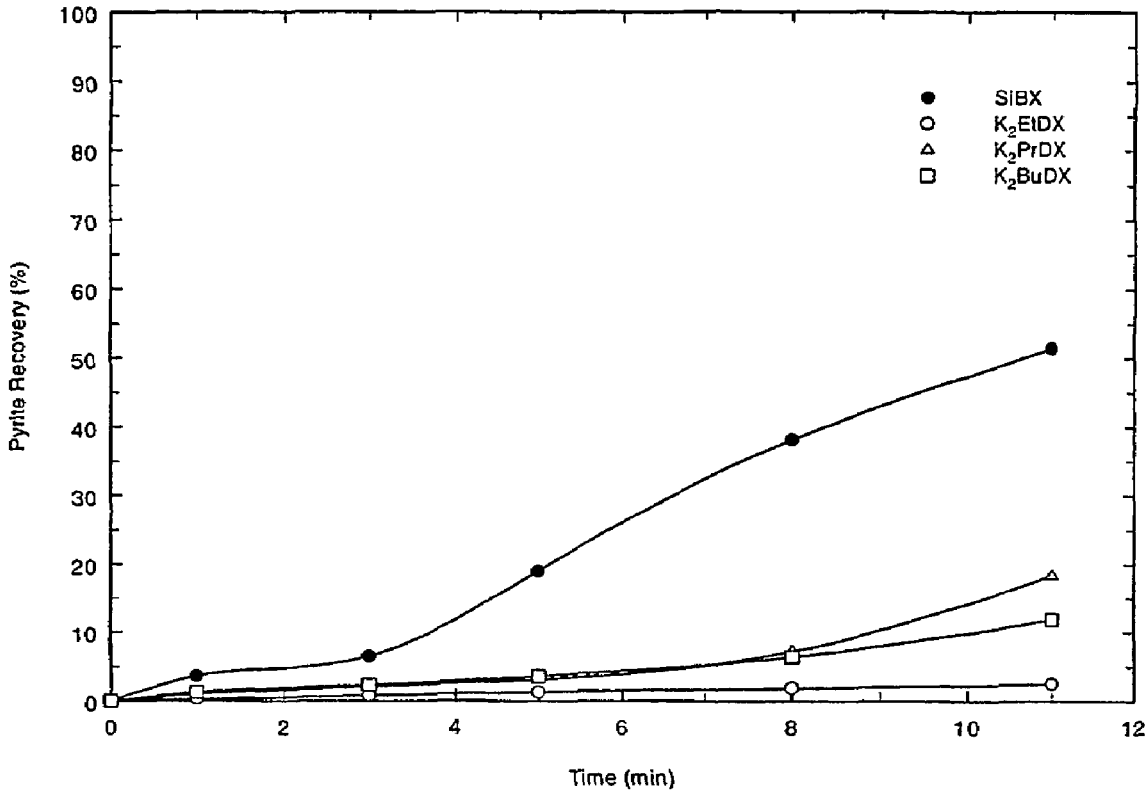
FIG. 6 is a graph of the recovery of pyrite throughout Cu ore floats using 0.045 mol/t SiBX, $K_2$EtDX, $K_2$PrDX and $K_2$BuDX.

FIG. 6 shows that the dixanthate collectors recovered substantially less pyrite than the conventional collector SiBX throughout the entire float.

The invention claimed is:

1. A method of selectively recovering a target sulphide mineral from an ore containing the target sulphide mineral and an iron sulphide gangue mineral comprising the steps of:

a) grinding the ore to liberate target mineral from the iron sulphide gangue mineral;

b) forming a pulp of said ore;

c) selecting a collector having two different hydrophilic functional head groups and a hydrophobic molecular chain of optimum length between the head groups;

d) the hydrophilic functional head groups being selected from the group consisting of xanthates and dithiocarbamates, and wherein one hydrophilic functional head group is xanthate and the second hydrophilic functional head group is dithiocarbamate;

e) adding the collector at a concentration at which the target mineral can be floated in preference to the iron sulphide material; and f) subjecting the pulp to froth flotation.

2. The method of claim 1 wherein the hydrophobic chain between the two functional head groups has a molecular chain length of 2–6 carbon atoms.

3. The method of claim 1 wherein the hydrophobic chain between the two functional head groups has a molecular chain length of 2–4 carbon atoms.

4. The method of claim 1 wherein the hydrophobic molecular chain is straight, branched, or aromatic.

5. The method of claim 1 wherein the hydrophobic molecular chain is a straight chain hydrocarbon.

6. The method of claim 1 wherein the target mineral is selected from the group of copper, nickel, lead and zinc based sulphide minerals.

7. The method of claim 1 wherein step (e) is preceded by the step of adjusting the pH to a level where flotation selectively of said target material is maximized.

8. A method of selectively recovering a target sulphide mineral from an ore containing the target sulphide mineral and an iron sulphide mineral comprising the steps of:

a) grinding the ore to liberate target mineral from the iron sulphide gangue mineral;

b) forming a pulp of said ore;

c) selecting a collector having the structure as follows:

X—R—Y where R is a branched or straight chain hydrophobic hydrocarbon or polyether chain, and the group -X is a xanthate and the group -Y is a dithiocarbamate;

d) adding the collector to the pulp at a concentration at which the target mineral is able to be floated in preference to the iron sulphide mineral; and e) subjecting the pulp to froth flotation.

9. The method of claim 8 wherein step d) is preceded by the step of adjusting pH to a level where the selectivity for the target mineral is maximized.

10. The method of claim 8 wherein R is a 2–4 molecule straight chain hydrocarbon.

11. The method of claim 8 wherein the target mineral is selected from the group of copper, nickel, lead and zinc based sulphide minerals.

* * * * *